US012702207B2

(12) United States Patent
Langwisch

(10) Patent No.: US 12,702,207 B2
(45) Date of Patent: Aug. 11, 2026

(54) PARASOL FOR SHADING SUNLIGHT

(71) Applicant: Britta Langwisch, Emden (DE)

(72) Inventor: Britta Langwisch, Emden (DE)

( * ) Notice: Subject to any disclaimer, the term of this patent is extended or adjusted under 35 U.S.C. 154(b) by 213 days.

(21) Appl. No.: 18/728,746

(22) PCT Filed: Dec. 21, 2022

(86) PCT No.: PCT/EP2022/087316

§ 371 (c)(1),
(2) Date: Jul. 12, 2024

(87) PCT Pub. No.: WO2023/134990

PCT Pub. Date: Jul. 20, 2023

(65) Prior Publication Data

US 2025/0331615 A1 Oct. 30, 2025

(30) Foreign Application Priority Data

Jan. 12, 2022 (DE) ..... 202022100148.0

(51) Int. Cl.

| | |
|---|---|
| ***A45B 25/26*** | (2006.01) |
| ***A45B 23/00*** | (2006.01) |
| ***A45B 25/18*** | (2006.01) |
| ***A45B 25/20*** | (2006.01) |
| ***A45B 25/22*** | (2006.01) |

(52) U.S. Cl.

CPC ..... *A45B 25/26* (2013.01); *A45B 23/00* (2013.01); *A45B 25/18* (2013.01); *A45B 25/22* (2013.01); *A45B 2025/183* (2013.01); *A45B 2200/1036* (2013.01)

(58) Field of Classification Search

CPC ... A45B 2025/183; A45B 25/18; A45B 25/20; A45B 25/22; A45B 25/26; A45B 220/1036; A45B 23/00

USPC ..... 135/33.7

See application file for complete search history.

(56) References Cited

U.S. PATENT DOCUMENTS

| | | | | | |
|---|---|---|---|---|---|
| 3,863,660 | A * | 2/1975 | Glaeser | A45B 25/20 | 135/33.7 |
| 4,804,008 | A * | 2/1989 | Ryder | A45B 25/22 | 135/33.7 |
| 4,978,110 | A * | 12/1990 | Lin | A45B 25/18 | 182/47 |
| D415,644 | S * | 10/1999 | Goodwin | D6/575 | |
| 6,131,591 | A * | 10/2000 | Hollah | A45B 25/18 | 135/33.7 |
| 6,223,758 | B1 * | 5/2001 | Feldman | A45B 25/20 | D3/6 |
| 10,745,918 | B2 * | 8/2020 | Fringero | G09F 23/04 | |
| 12,345,064 | B2 * | 7/2025 | Dresch | E04H 15/54 | |
| 2002/0189656 | A1 * | 12/2002 | David | A45B 25/22 | 135/33.7 |

(Continued)

FOREIGN PATENT DOCUMENTS

| | | |
|---|---|---|
| CN | 202286664 U | 7/2012 |
| DE | 20115810 U1 | 3/2002 |

(Continued)

*Primary Examiner* — Robert Canfield

(74) *Attorney, Agent, or Firm* — MUNCY, GEISSLER, OLDS & LOWE, P.C.

(57) ABSTRACT

A parasol for protection from sunlight is provided with at least one surface element as a parasol canopy, and a plurality of incisions are introduced in the surface element.

6 Claims, 2 Drawing Sheets

(56) References Cited

U.S. PATENT DOCUMENTS

Figure 1:
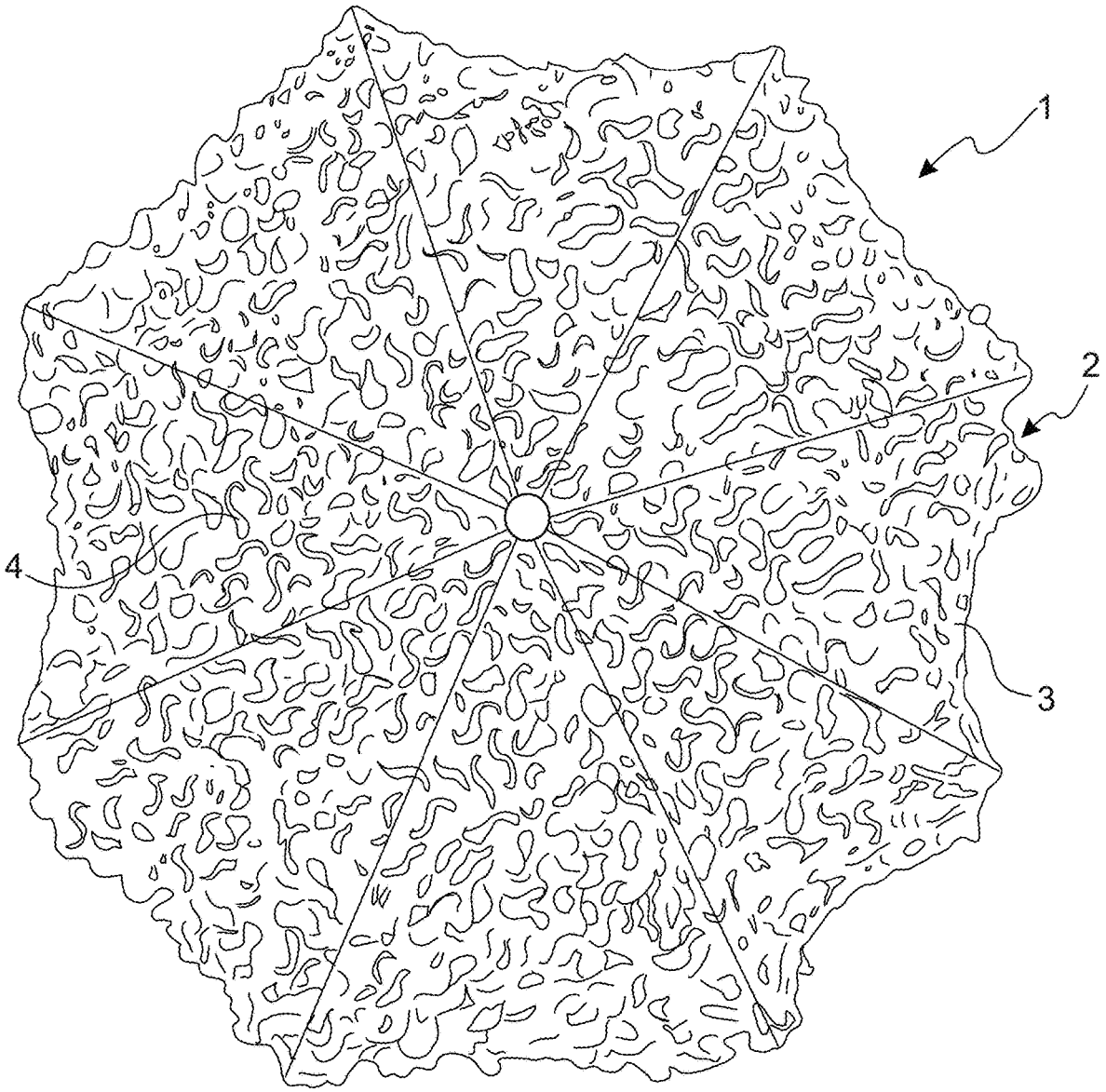

| | | | | |
|---|---|---|---|---|
| 2010/0258151 | A1* | 10/2010 | Vogt | A45B 25/20<br>135/33.7 |
| 2025/0116901 | A1* | 4/2025 | Guo | G02F 1/134345 |

FOREIGN PATENT DOCUMENTS

| | | | | | |
|---|---|---|---|---|---|
| ES | 1253993 | U | | 10/2020 | |
| FR | 2784272 | A1 | | 4/2000 | |
| GB | 344582 | A | | 3/1931 | |
| JP | S60140421 | U | * | 9/1985 | |
| JP | H11332624 | A | * | 12/1999 | |
| JP | 3076743 | U | * | 4/2001 | |
| JP | 2019017754 | A | * | 2/2019 | A45B 25/18 |
| WO | 2019017012 | A1 | | 1/2019 | |

* cited by examiner

PARASOL FOR SHADING SUNLIGHT

BACKGROUND OF THE INVENTION

Field of the Invention

The invention relates to a parasol for shading sunlight with at least one surface element as a parasol canopy.

Description of Related Art

Parasols are not only used to defend against moisture from rain or snow, their use relates to the aforementioned shading of sunlight, particularly in the summer months. Parasols are used, for example, on balconies or terraces or also in restaurants or cafés with outdoor areas.

Parasols are also known in design as pavilions or awnings for shading sunlight with a closed surface element as a parasol canopy. This succeeds in shading sunlight, but no other effects can be achieved by means of it.

SUMMARY

The object of the invention is to illustrate a parasol of the aforementioned type, which can still serve to shade sunlight but also provide effects.

According to the invention, this task is solved by means of plurality of incisions being introduced into the surface element.

The parasol according to the invention is characterized by incisions, not by removing sections of the surface from the parasol canopy. The surface element still exists in its entirety so that shading of sunlight continues to occur.

However, the incisions of the surface element of the parasol according to the invention loosen up the parasol canopy. Incisions can lead to a displacement of adjacent sections of the surface element, through which some sunlight can pass. In addition, movements in the surface element can also occur due to air movements due to the inserted incisions, for example, in a jagged or wavy shape. This can result in an effective play of light and shadow.

According to a first further embodiment of the invention, it is provided that the distance between adjacent incisions is less than the length of the incisions. For example, the incisions can be 5 cm to 20 cm long. The incisions are then arranged close to each other, resulting in small sections of the surface element that are surrounded by other sections. These small sections of the surface element can be diverted upwards or downwards from the surface element, provided that the parasol canopy is essentially arranged in a horizontal manner. The incisions are designed in such a way that there is no significant weakening of the surface element.

According to next further development of the invention, it is provided that the incisions will progress on the surface element following a linear path, thereby forming the letter "S" at least in sections. The incisions can each be shaped like an "S". This results in rounded sections within the surface element, which are partially covered by an incision just in the area of a curve in the "S". These rounded sections can then be lifted out of the plane of the surface element, for example by wind power, which can cause the surface element to flutter, which then also results in a corresponding moving silhouette. Other forms of incisions are possible, e.g., in waves or in jagged shapes.

Preferably, the parasol according to the invention is a large parasol that can be used on terraces and in outdoor areas of restaurants or similar. A preferred area of application can also be outdoor gastronomy in beach areas or also private use directly on the beach.

The surface element is preferably a cotton fabric. It is still preferentially part of a covering, as is common for parasols and, in particular, large parasols.

In the case of the parasol according to the invention, it can be provided that the incisions in at least one section of the surface element are evenly distributed. For example, it can be provided that, in a parasol according to the invention, there are sections that alternate between an intact surface element and sections with a surface element with incisions. This can create optical effects.

In a special way, however, it is provided that the incisions are evenly distributed over the surface element. The entire surface element is therefore provided with incisions; the incisions are evenly distributed across the entire extent of the surface element.

BRIEF DESCRIPTION OF THE SEVERAL VIEWS OF THE DRAWING(S)

Figure 2:
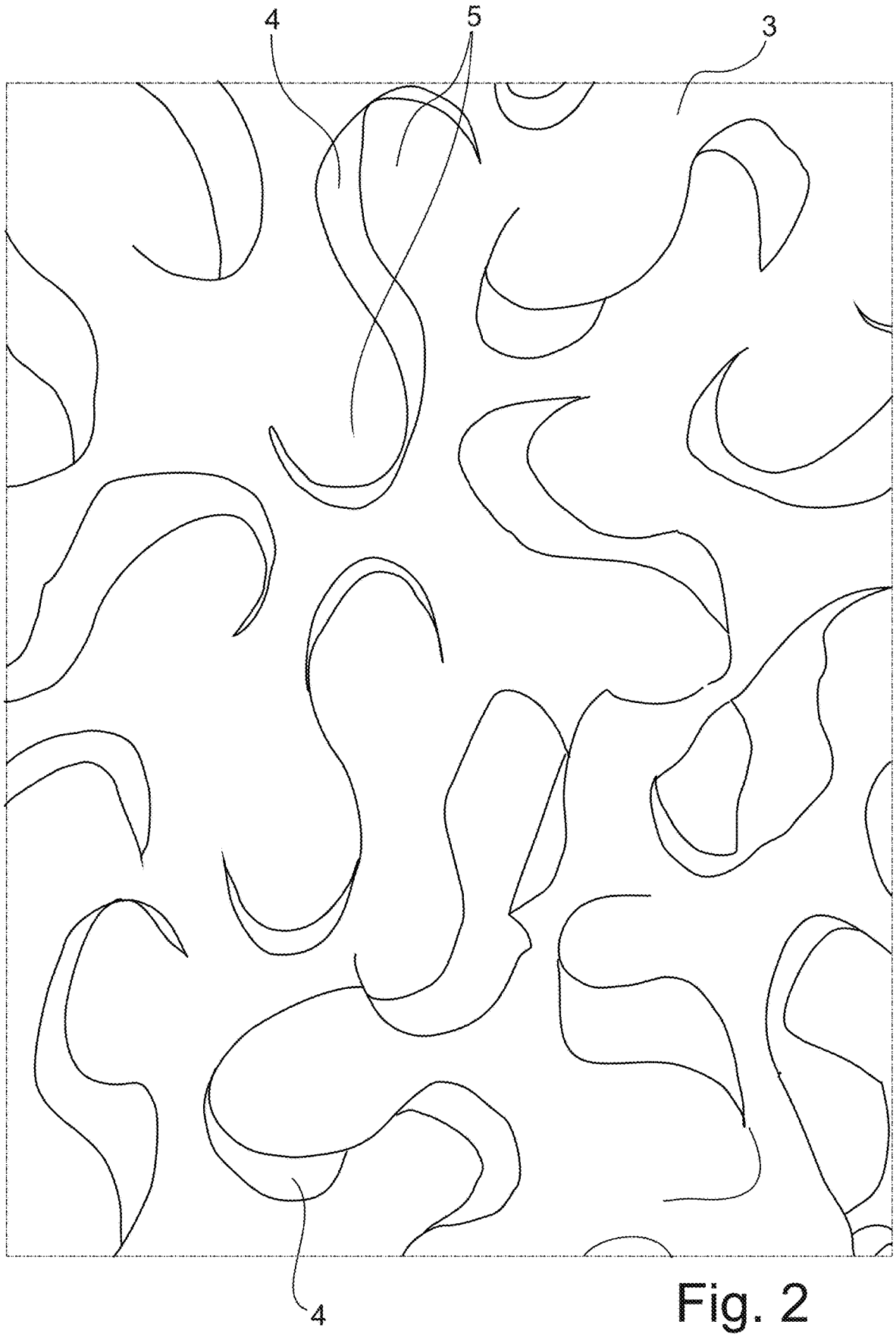

An exemplary embodiment of the invention is shown in the drawing. The figures show:

FIG. 1: a top view of the parasol canopy of an parasol according to the invention and FIG. 2: a partial view of the parasol canopy enlarged to scale in accordance with FIG. 1.

DETAILED DESCRIPTION OF THE INVENTION

The parasol 1 shown in FIG. 1 is a large parasol. The parasol canopy 2 is formed by a surface element 3 into which a plurality of incisions 4 are introduced. The incisions 4 are evenly distributed over the surface element 3, whereby incisions 4 are formed across the entire extent of the surface element 3.

FIG. 2 shows a section of the surface element 3. Due to the insertion of incisions 4, gaps are created in surface element 3. The gaps are caused by a raising or lowering of sections of the surface element 3 due to gravity or exposure to the wind. Incisions 4 each progress in the shape of an "S". This results in rounded overlapping areas 5 in the surface element 3. These overlapping areas 5 can move to the canopy 2 in the event of a wind attack and thus form interesting effects with the help of sun and shade.

The invention claimed is:

1. A parasol for shading sunlight with at least one surface element as a parasol canopy, wherein a plurality of incisions have been introduced in the surface element and wherein at least some of the incisions are substantially shaped like the letter "S".

2. The parasol according to claim 1, wherein a distance to each other of adjacent incisions is less than a length of the incisions.

3. The parasol according to claim 1, wherein the surface element is a cotton fabric.

4. The parasol according to claim 1, wherein the surface element is a part of a covering.

5. The parasol according to claim 1, wherein the incisions are uniformly distributed in at least one section of the surface element.

6. The parasol according to claim 1, wherein the incisions are evenly distributed over the surface element.

* * * * *